US006755053B1

(12) United States Patent
Dias

(10) Patent No.: US 6,755,053 B1
(45) Date of Patent: Jun. 29, 2004

(54) SECURITY COVER FOR A COIN-OPERATED CAR WASH MACHINE

(76) Inventor: William A. Dias, 1293 N. Applegate Rd., Atwater, CA (US) 95301

( * ) Notice: Subject to any disclaimer, the term of this patent is extended or adjusted under 35 U.S.C. 154(b) by 0 days.

(21) Appl. No.: 10/445,445

(22) Filed: May 28, 2003

(51) Int. Cl.[7] ..... E05B 73/00

(52) U.S. Cl. ..... 70/14; 70/168; 70/416; 292/289

(58) Field of Search ..... 70/14, 158–169, 70/416, 417; 109/58–59 R; 292/259 R, 258, 256, 338, 339, 288, 289, 292

(56) References Cited

U.S. PATENT DOCUMENTS

| | | | | | |
|---|---|---|---|---|---|
| 109,330 | A | * | 11/1870 | Maddox | 292/256.5 |
| 1,955,462 | A | * | 4/1934 | Kaufman | 70/57 |
| 2,853,231 | A | * | 9/1958 | Yorgey et al. | 232/43.4 |
| 3,276,835 | A | * | 10/1966 | Hall | 312/333 |
| 3,280,606 | A | * | 10/1966 | Howard et al. | 292/259 R |
| 3,656,788 | A | * | 4/1972 | Emery | 292/148 |
| 3,665,736 | A | * | 5/1972 | Wilson | 70/78 |
| 4,418,551 | A | * | 12/1983 | Kochackis | 70/18 |
| 4,562,708 | A | * | 1/1986 | Gros | 70/94 |
| 4,704,881 | A | * | 11/1987 | Sloop, Sr. | 70/158 |
| 4,998,425 | A | * | 3/1991 | Hoogland | 70/159 |
| 5,014,527 | A | * | 5/1991 | Traller et al. | 70/94 |
| 5,077,940 | A | * | 1/1992 | LaRose, Jr. | 49/503 |
| D325,159 | S | * | 4/1992 | Pearson | D8/346 |
| 5,108,166 | A | * | 4/1992 | Klix | 312/329 |
| D329,801 | S | * | 9/1992 | Pearson | D8/346 |
| 5,148,476 | A | * | 9/1992 | Zausner | 379/437 |
| 5,267,688 | A | * | 12/1993 | Benefield | 232/17 |
| 5,321,961 | A | * | 6/1994 | Barberi | 70/56 |
| 5,402,476 | A | * | 3/1995 | Ohayon | 379/145 |
| D378,917 | S | * | 4/1997 | Ohayon | D14/146 |
| 6,578,398 | B2 | * | 6/2003 | Behunin | 70/417 |
| 6,591,765 | B2 | * | 7/2003 | Braddock | 109/52 |

* cited by examiner

*Primary Examiner*—Suzanne Dino Barrett

(57) ABSTRACT

A security cover for a coin-operated car wash machine is rectangular and slides over a car wash machine. It has a partial front panel that covers the coin drawer of the car wash machine. A bar extends through the machine and through a slot in each of the side panels of the security cover. Each end of the bar extends slightly beyond the side panels of the security cover and each end has an opening through which a padlock could extend to deter theft and vandalism.

16 Claims, 2 Drawing Sheets

SECURITY COVER FOR A COIN-OPERATED CAR WASH MACHINE

BACKGROUND OF THE INVENTION

1. Field of the Invention

The present invention relates to a security cover for a coin-operated car wash machine for use in connection with preventing theft from a coin-operated car wash machine. The security cover for a coin-operated car wash machine has particular utility in connection with preventing theft and destruction of coin-operated machines.

2. Description of the Prior Art

Security cover for a coin-operated car wash machines are desirable for preventing theft and destruction to coin operated car wash machines.

The use of security cages for coin operated machines is known in the prior art. For example, U.S. Pat. No. 5,321,961 to Barberi discloses a security door for coin operated machines. However, the Barberi '961 patent ony covers the coin drawer and does not cover the entire machine, and has further drawbacks of being hingedly affixed to the machine.

U.S. Pat. No. 2,716,882 to Gill et al discloses a guard for protecting coin-operated switches and like metering systems from theft of coins contained within. However, the Gill et al '882 patent has a cover with a back so that it encircles the entire machine, and additionally does not have more than one lock.

Similarly, U.S. Pat. No. 4,418,551 to Kochackis discloses a vending machine security cage that protects the cash box of a vending machine from theft. However, the Kochackis '551 patent has multiple straps that do not totally encase the machine, and has only one lock.

Lastly, U.S. Pat. No. 5,806,652 to Johnson et al discloses a tamper-resistant anti-theft guard for coin collection. However, the Johnson et al '652 patent does not have a locking crossbar, and has the additional deficiency of having baffles within the coin slots to prevent money from being withdrawn from the slots.

While the above-described devices fulfill their respective, particular objectives and requirements, the aforementioned patents do not describe a security cover for a coin-operated car wash machine that allows the prevention of theft and vandalism. The present invention fully encloses the coin-operated car wash machine. The present invention has triangular sections at the upper corners to protect the security cover from being removed from the coin-operated car wash machine. The present invention also has vertical slots in each side which enables a steel bar to pass through thereby further protecting the machine. The security cover additionally has dual padlocks to further prevent theft and vandalism to the coin-operated car wash machine. Therefore, a need exists for a new and improved security cover for a coin-operated car wash machine that can be used for the prevention of theft and vandalism. In this regard, the present invention substantially fulfills this need. In this respect, the security cover for a coin-operated car wash machine according to the present invention substantially departs from the conventional concepts and designs of the prior art, and in doing so provides an apparatus primarily developed for the purpose of the prevention of theft and vandalism.

SUMMARY OF THE INVENTION

In view of the foregoing disadvantages inherent in the known types of security cages now present in the prior art, the present invention provides an improved security cover for a coin-operated car wash machine, and overcomes the above-mentioned disadvantages and drawbacks of the prior art. As such, the general purpose of the present invention, which will be described subsequently in greater detail, is to provide a new and improved security cover for a coin-operated car wash machine and method which has all the advantages of the prior art mentioned heretofore and many novel features that result in a security cover for a coin-operated car wash machine which is not anticipated, rendered obvious, suggested, or even implied by the prior art, either alone or in any combination thereof.

To attain this, the present invention essentially comprises a security cover for a coin-operated car wash machine. The security cover is essentially a rectangular cover with a top, a bottom, and opposing side walls. The back of the security cover is open and the front portion extends approximately a third of the way up from the bottom portion. A triangular shaped section is positioned within each of the upper front corners of the security cover. The remaining front of the security cover is open to allow manipulation of the controls of the coin-operated car wash. The bottom front portion of the security cover encases the coin drawer of the coin-operated car wash machine. The center of each of the opposing side surfaces has a vertical slot measuring approximately two inches long and a half an inch wide. An elongated bar is engaged with each of these slots so that the ends of the bar protrude from the sides of the security cover. Each end of the bar has an opening through which a padlock can be engaged to secure the bar to the security cover. The security cover would be made of stainless steel for its strength.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved security cover for a coin-operated car wash machine that has all of the advantages of the prior art security cages and none of the disadvantages.

It is another object of the present invention to provide a new and improved security cover for a coin-operated car wash machine that may be easily and efficiently manufactured and marketed.

An even further object of the present invention is to provide a new and improved security cover for a coin-operated car wash machine that has a low cost of manufacture with regard to both materials and labor, and which accordingly is then susceptible of low prices of sale to the consuming public, thereby making such security cover for a coin-operated car wash machine economically available to the buying public.

Still another object of the present invention is to provide a new security cover for a coin-operated car wash machine that provides in the apparatuses and methods of the prior art some of the advantages thereof, while simultaneously overcoming some of the disadvantages normally associated therewith.

Even still another object of the present invention is to provide a security cover for a coin-operated car wash machine for the prevention of theft and vandalism. The security cover of the present invention would be very easy to use. Owners would no longer have to worry about vandals smashing open the coin drawer of the machine and stealing money. The security cover would deter thieves and thwart any attempt to break into the machine thereby preventing costly damage to the machine.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
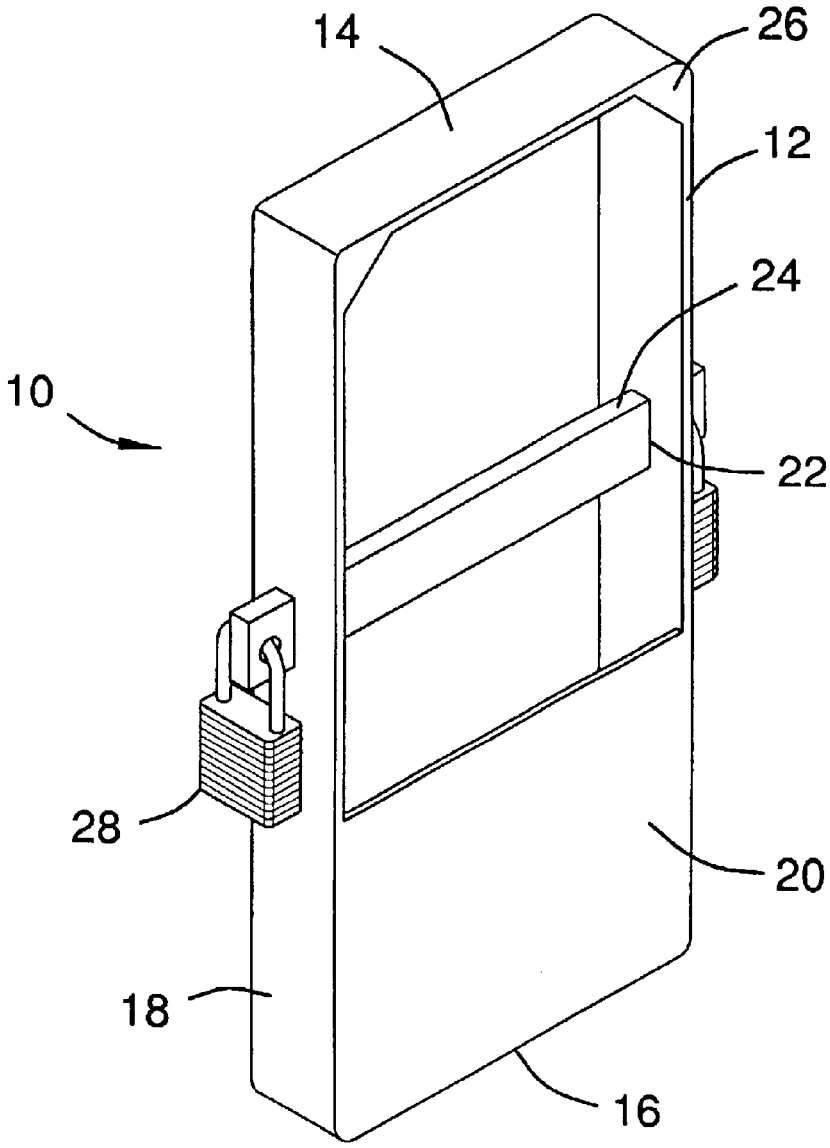
FIG. 1 is a left front perspective view of the preferred embodiment of the security cover for a coin-operated car wash machine constructed in accordance with the principles of the present invention.
Figure 2:
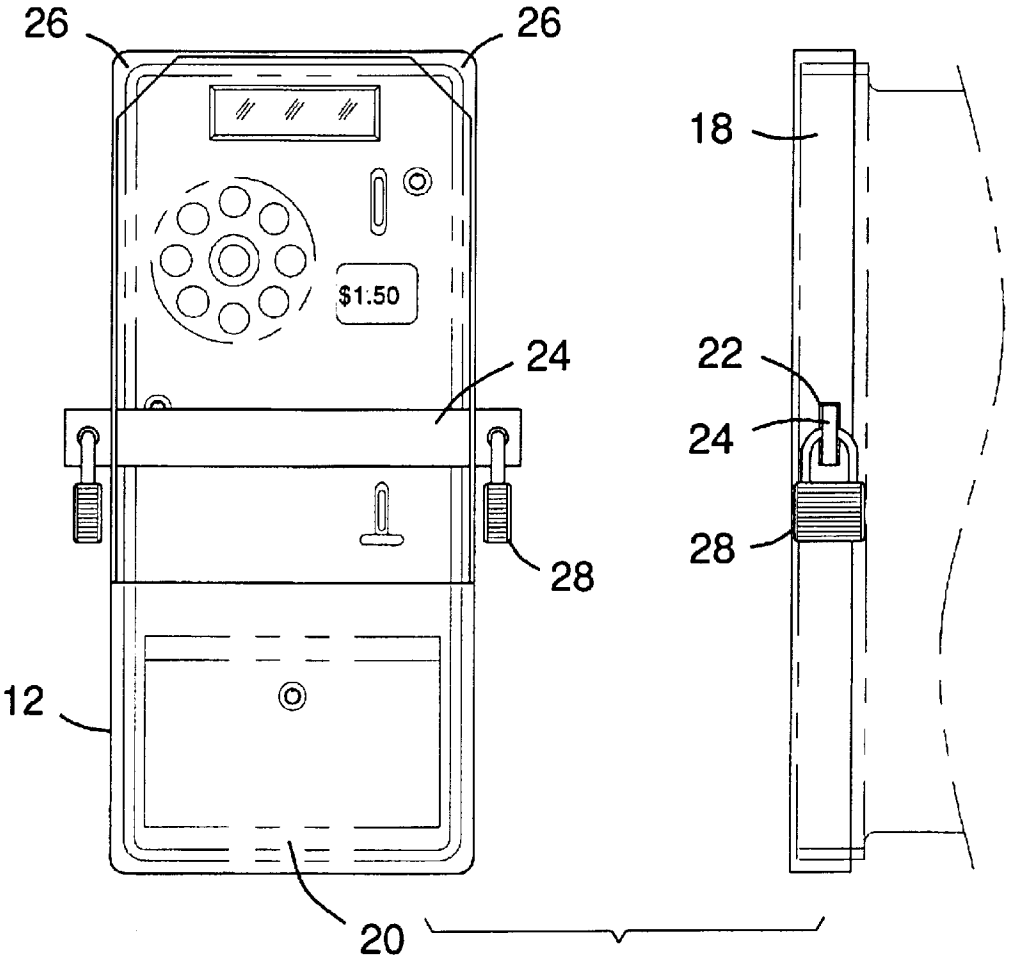
FIG. 2 is a front plan view and a side plan view of the security cover for a coin-operated car wash machine of the present invention wherein the dashed lines represent the coin-operated car wash machine and are not a part of this invention.

Referring now to the drawings, and particularly to FIGS. 1–2, a preferred embodiment of the security cover for a coin-operated car wash machine of the present invention is shown and generally designated by the reference numeral 10.

In FIG. 1, a new and improved security cover for a coin-operated car wash machine 10 of the present invention for the prevention of theft and vandalism to coin-operated car wash machines is illustrated and will be described. More particularly, the security cover for a coin-operated car wash machine 10 is comprised of a hollow rectangular enclosure 12 having a top 14, a bottom 16, opposing side walls 18 and a partial front portion 20. The back of the enclosure 12 is open. The partial front portion 20 extends upwards from the bottom surface 16 approximately one third of the height of the enclosure 12. The partial front portion 20 covers the coin drawer of the car wash machine to deter vandalism and theft of the contents of the drawer. A vertical slot 22 is cut into the center of each of the opposing side walls 18 intermediate to the ends of the side walls 18. Each slot 22 is preferably 1¾ inches long and ½ inch wide. An elongated bar 24, also manufacture of stainless steel extends the length of the enclosure 12 and beyond and is slidably engaged within each slot 22 on the side walls 18. The bar 24 measures approximately 11¼ inch long, ¼ inch thick, and 1 inch high. Each end of the bar 24 would have a hole through which a padlock 28 would be placed to secure the security cover 10 to the car wash machine. A pair of triangular braces 26 are each welded onto each upper front corner of the enclosure 12. The braces 26 reinforce the security cover 10 over the car wash machine. The enclosure 12 measures approximately 20 inches in height, 1½ inches in depth, and 9 inches wide. However, the security cover 10 can be manufactured in alternate sizes to accommodate a variety of different types of car wash machines. The enclosure 12 is manufactured of stainless steel due to its durability and strength.

FIG. 2 shows the security cover 10 in use over the car wash machine. The enclosure 12 is placed over the machine so that the partial front surface 20 covers the coin drawer of the car wash machine. The front partial wall 20 is only approximately ⅓ of the total height of the enclosure 12, so that only the coin drawer is covered. The remainder of the front of the enclosure 12 is left open so as to expose the controls of the car wash machine. The triangular braces 26 rest against the upper front corners of the car wash machine and the top surface 14 of the enclosure is coplanar with the top surface of the car wash machine. The enclosure 12 rests snugly against the car wash machine. The bar 24 is inserted into one of the slots 22 in the enclosure 12 and extends through the machine and out through the other slot 22 on the opposing side wall 18. A pair of padlocks 28 are then placed through the holes in the bar 24 to secure the security cover 10 to the car wash machine. Different types of padlocks 28 can be used, such as a combination lock or a key lock.

While a preferred embodiment of the security cover for a coin-operated car wash machine has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A security cover for a coin-operated car wash machine comprising:

a hollow rectangular enclosure having a top, a bottom, opposing side walls, and a partial front portion, wherein each of said opposing side walls defines a slot therein and wherein said partial front portion extends from said bottom portion upwards approximately one third of the height of said enclosure;

an elongated bar wherein said bar defines a pair of holes therein and wherein said holes are placed near each end of the bar and wherein said bar is slidably engageable with said slots in said side surfaces of said enclosure, said bar being slidable through both of said slots in its entirety, thereby allowing said bar to be inserted into or removed from either side of said enclosure;

a pair of triangular braces wherein said braces are placed in the upper front corners of said enclosure and wherein one of each of said braces are welded to both said top surface and one of said opposing side walls;

a pair of padlocks wherein said padlocks are engaged with said holes in each said end of said bar.

2. The apparatus of claim 1, wherein said enclosure is manufactured of stainless steel.

3. The apparatus of claim 1, wherein said partial front surface covers the coin drawer of the car wash machine.

4. The apparatus of claim 1, wherein said slots are located intermediate to the ends of said side walls.

5. The apparatus of claim 1, wherein said bar is longer in length than the length of the enclosure.

6. The apparatus of claim 1, wherein said bar is manufactured of stainless steel.

7. The apparatus of claim 1, wherein said braces are manufactured of stainless steel.

8. The apparatus of claim 1, wherein said padlocks are manufactured of a type selected from the set of combination locks and key locks.

9. A security cover for a coin-operated car wash machine comprising:

a hollow stainless steel rectangular enclosure having a top, a bottom, opposing side walls, and a partial front portion, wherein each of said opposing side walls defines a slot therein and wherein said partial front portion extends from said bottom portion upwards approximately one third of the height of said enclosure;

an elongated stainless steel bar wherein said bar defines a pair of holes therein and wherein said holes are placed near each end of the bar and wherein said bar is slidably engageable with said slots in said side walls of said enclosure, said bar being slidable through both of said slots in its entirety, thereby allowing said bar to be inserted into or removed from either side of said enclosure;

a pair of stainless steel triangular braces wherein said braces are placed in the upper front corners of said enclosure and wherein one of each of said braces are welded to both said top surface and one of said opposing side surfaces;

a pair of padlocks wherein said padlocks are engaged with said holes in each said end of said bar.

10. The apparatus of claim 9, wherein said partial front surface covers the coin drawer of the car wash machine.

11. The apparatus of claim 9, wherein said slots are located intermediate to the ends of said side walls.

12. The apparatus of claim 9, wherein said bar is longer in length than the length of the enclosure.

13. The apparatus of claim 9, wherein said padlocks are manufactured of a type selected from the set of combination locks and key locks.

14. A security cover for a coin-operated car wash machine comprising:

a hollow stainless steel rectangular enclosure having a top, a bottom, opposing side walls, and a partial front portion, wherein each of said opposing side walls defines a slot therein and wherein said slots are located intermediate to the ends of said side walls and wherein said partial front portion extends from said bottom portion upwards approximately one third of the height of said enclosure to cover the coin drawer of a car wash machine;

an elongated stainless steel bar wherein said bar defines a pair of holes therein and wherein said holes are placed near each end of the bar and wherein said bar is slidably engageable with said slots in said side walls of said enclosure, said bar being slidable through both of said slots in its entirety, thereby allowing said bar to be inserted into or removed from either side of said enclosure;

a pair of stainless steel triangular braces wherein said braces are placed in the upper front corners of said enclosure and wherein one of each of said braces are welded to both said top surface and one of said opposing side walls;

a pair of padlocks wherein said padlocks are engaged with said holes in each said end of said bar.

15. The apparatus of claim 14, wherein said bar is longer in length than the length of the enclosure.

16. The apparatus of claim 14, wherein said padlocks are manufactured of a type selected from the set of combination locks and key locks.

* * * * *